United States Patent [19]

Antoine et al.

[11] Patent Number: 4,572,077

[45] Date of Patent: Feb. 25, 1986

[54] PROJECTILE FOR HAND AND SHOULDER WEAPONS AND A CARTRIDGE FITTED WITH SAID PROJECTILE

[75] Inventors: Robert Antoine, Varennes Vauzelles; Jacques Laurin, Nevers, both of France

[73] Assignee: Societe Francaise de Munitions, Paris, France; a part interest

[21] Appl. No.: 670,118

[22] Filed: Nov. 9, 1984

Related U.S. Application Data

[63] Continuation of Ser. No. 415,032, Sep. 7, 1982, abandoned.

[30] Foreign Application Priority Data

Sep. 24, 1981 [FR] France ..... 81 18499

[51] Int. Cl.[4] ..... F42B 5/02

[52] U.S. Cl. ..... 102/439; 102/501

[58] Field of Search ..... 102/436, 439, 501, 503, 102/507, 443, 448

[56] References Cited

U.S. PATENT DOCUMENTS

| | | | |
|---|---|---|---|
| 209,127 | 10/1878 | Marston | 102/430 |
| 1,178,516 | 4/1916 | Hardcastle | 102/501 |
| 1,669,969 | 5/1928 | Caruth . | |
| 3,557,702 | 1/1971 | Benson . | |
| 3,747,533 | 7/1973 | Rossmann . | |
| 3,948,180 | 4/1976 | Silvia . | |

FOREIGN PATENT DOCUMENTS

| | | | |
|---|---|---|---|
| 427713 | 8/1911 | France | 102/501 |
| 24404 | 7/1922 | France | 102/501 |
| 2321108 | 11/1977 | France . | |
| 252315 | 3/1927 | Italy | 102/430 |
| 368735 | 5/1963 | Switzerland | 102/503 |

*Primary Examiner*—Harold J. Tudor

*Attorney, Agent, or Firm*—Young & Thompson

[57] ABSTRACT

A projectile for hand and shoulder weapons has a cylindrical body and a nose, the longitudinal cross-section of the nose being defined by two concave lines which are symmetrical with respect to the axis of the projectile. An internal cavity formed within the projectile body and open at the end remote from the nose is at least partly filled with charge power which has been introduced into the cartridge case. The initial velocity thus imparted to the projectile is higher than that of a projectile of the conventional type and of the same caliber.

3 Claims, 2 Drawing Figures

PROJECTILE FOR HAND AND SHOULDER WEAPONS AND A CARTRIDGE FITTED WITH SAID PROJECTILE

This application is a continuation of application Ser. No. 415,032, filed 9/7/82 now abandoned.

This invention relates to a projectile or bullet which is intended to be fired by all hand weapons and shoulder weapons of the rifled or smooth-bore type without any need to modify such weapons, the function of said projectile being primarily to produce high-power neutralizing effects.

Projectiles which are employed in particular by police forces for antipersonnel combat are subject to special requirements. These projectiles must produce useful and effective action even at different firing distances. In other words, they must release maximum energy at the time of impact while constituting no danger for persons located behind the wrongdoer and exposing innocent persons in the immediate vicinity of a wrongdoer to only minimum danger. At the same time, these projectiles must also be capable of piercing hard targets such as vehicle bodies and still have sufficient energy to reach and disable the occupant of the vehicle. Projectiles of this type should preferably be suitable in addition for universal use by police forces and must ensure perfect operation of all types of rifled or smooth-bore firearms consisting of either hand or shoulder weapons and operated even at high rates of fire.

Furthermore, it must be ensured in particular that projectiles designed for use by police forces must be absolutely in accordance with the Hague Conventions both before and after the effect at the target. This precludes the use of all projectiles which have so-called "hollow noses" before and after the effect at the target and, of course, all explosive projectiles. These conventions also prohibit the use of projectiles having noses which are deformable at the instant of impact, especially by radial enlargement of the bullet. In addition, projectiles of this type would have only low perforating power and would not be capable of passing through hard targets.

With a view to satisfying the conditions set forth in the foregoing, it is not possible on the other hand to contemplate any increase in the weight of the projectile although this is the solution that naturally comes to mind. Although it is true to state that the penetrating power is increased with the weight of the bullet, it is not certain that this will have the effect of instantaneously immobilizing a wrongdoer and if the bullet passes through his body it may retain a sufficient degree of kinetic energy to injure a person behind him.

In order to limit the penetration of the bullet, a conceivable expedient would be to provide a bullet nose which, looking from the exterior, widens progressively from the tip and has a concave profile.

In this case, however, the penetration of the projectile would be rapidly slowed-down and the injury thus inflicted would be too superficial to produce a shock effect and immobilize the wrongdoer.

The object of the present invention is to provide a projectile which is designed especially for use by police forces and complies with the above-mentioned conditions of immediate immobilization without passing through the human body while still having a sufficient penetrating power to pass through hard bodies and also remaining in accordance with the Hague Conventions.

A complementary aim of the invention is to provide a projectile which can be utilized by all hand or shoulder weapons without modifying these latter. The condition just mentioned is in fact very important for the adoption of novel ammunition by police forces but the difficulty of the problem presented is thus complicated to an appreciable extent.

In accordance with the invention, the nondeformable projectile for hand and shoulder weapons comprising a body and a nose is distinguished by the fact that the longitudinal cross-section of said nose is defined by two lines which are concave when seen from the exterior and symmetrical with respect to the axis of the projectile. Means are provided in combination for imparting to said projectile an initial velocity which is higher than that of a projectile of conventional type and of the same caliber. Said means comprise a cavity within the body, said cavity being open at the end remote from the nose and intended to be filled at least to a partial extent with charge powder which has been introduced into the cartridge case of said projectile.

Experience has shown that the particular conditions laid down by the invention have been satisfied by the combination of the above-mentioned profile and of the internal cavity of the projectile which serves to increase the powder charge without changing the dimensions of the cartridge case and therefore without modifying the caliber of the weapon in spite of the reduction in weight of the projectile.

These results can be explained by considering that the projectile nose having a concave external shape ensures lateral rejection of tissues at the time of impact and this produces a splayed-out wound. At the same time, the initial high velocity of the bullet obtained by the increased powder charge is sufficient to ensure that the bullet penetrates in such a manner as to produce a shock effect which immediately disables the wrongdoer.

Furthermore, the special shape of the nose of the projectile in accordance with the invention makes it possible to limit the dangerous range of the projectile, thereby reducing the hazards to which persons may be exposed when not involved in combat but placed behind or close to a wrongdoer. At the same time, the high initial velocity imparted to the projectile ensures accuracy of firing and a range which is sufficient to meet the usual requirements of police forces.

The means provided by the invention are represented in addition by an increase in kinetic energy of the projectile (which is proportional to $MV^2$, where M designates the mass and V designates the initial velocity) since a reduction in mass is highly compensated by the increase in velocity. This explains the extent of the destructive effects observed. On the contrary, the linear momentum corresponding to MV is reduced in the majority of instances, thus reducing recoil of the weapon at the time of firing.

It is further apparent that these very advantageous effects can be obtained without any modification of the caliber of the firearm.

Preferably, the means provided for imparting to the projectile an initial velocity which is higher than that of a conventional projectile having the same caliber are such that said velocity is two or three times greater.

In an advantageous embodiment of the invention, the tangent to each concave line mentioned above forms with the axis of the projectile an angle which is larger near the base of the nose than at the free end of this latter although it will be noted that this angle does not exceed 90° at the base.

Experience has demonstrated the fact that a profile of this type permits the achievement of high perforating power as well as a slowing-down effect and optimum crushing of tissues after impact.

In a preferred embodiment of the invention, the surface of the projectile nose has a substantially negative-concave-paraboloid shape whilst the internal cavity which is open at the end remote from the nose and is intended to be filled at least partly with charge powder introduced into the cartridge case has an internal profile which is comparable with the nose profile in order to eliminate any zone of least resistance which would have the effect of thrusting the head of the projectile into the interior of said cavity at the time of impact with a hard body.

These and other features of the invention will be more apparent upon consideration of the following description and accompanying drawings, wherein.

Figure 1:
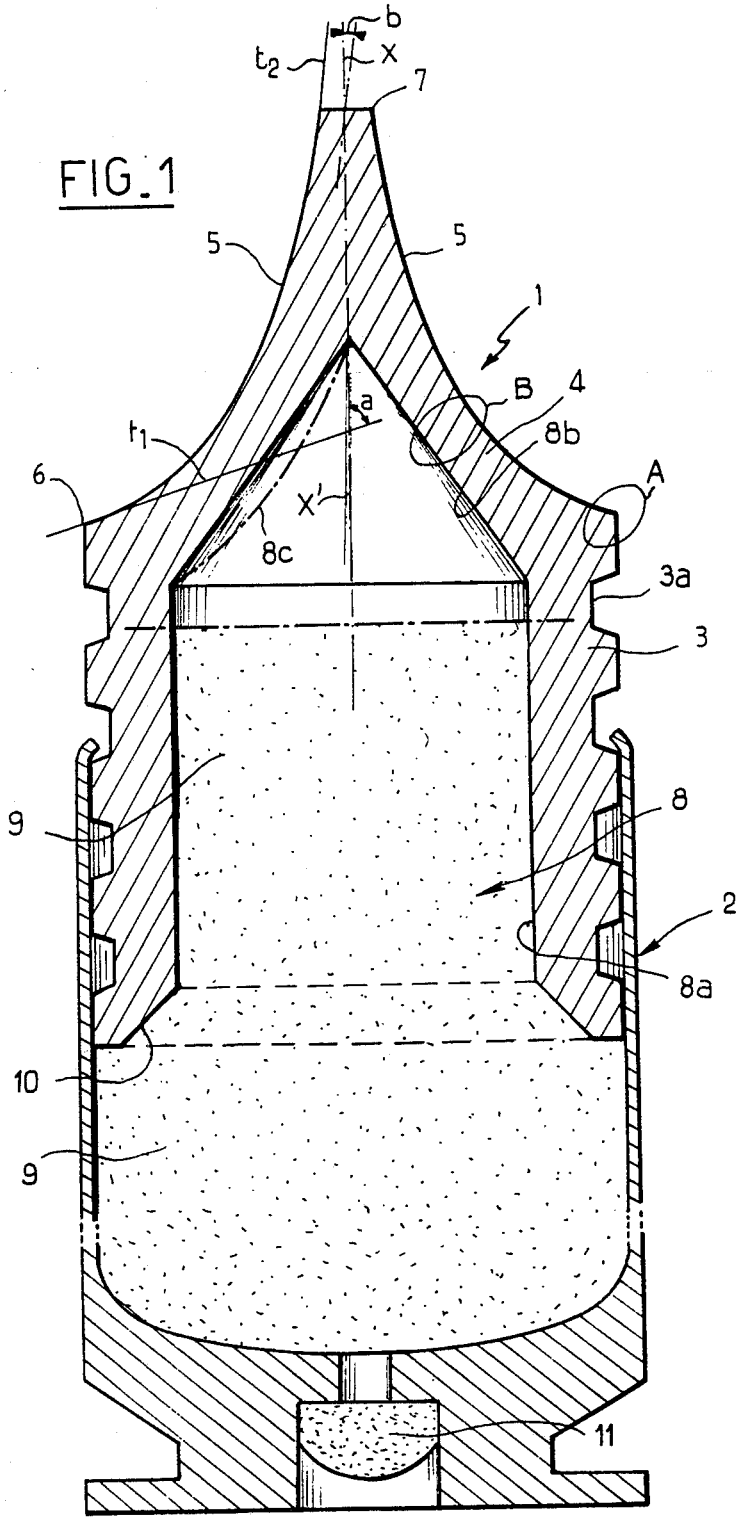
FIG. 1 is a longitudinal sectional view of a cartridge case fitted with a projectile in accordance with the invention.

In the embodiment of FIG. 1, the projectile 1 in accordance with the invention is crimped within a cartridge case 2 of conventional structure which is provided at its base with a primer 11. The projectile 1 comprises a cylindrical body 3 which is partially engaged in the cartridge case 2 and a nose 4. The cylindrical body 3 is provided with annular grooves or cannelures 3*a* filled with a lubricant of known type and housed within the portion which is engaged within the cartridge case 2. The projectile 1 is formed of material and has a profile such that said projectile is not substantially deformed at the time of impact. The material may consist, for example, of copper or of a copper-base alloy.

The longitudinal cross-section of the nose 4 is defined by two concave lines 5 which are symmetrical with respect to the axis X—X′ of the projectile.

The tangent ($t_1$, $t_2$) to each of the concave lines 5 forms with the axis X—X′ of the projectile 1 an angle which is larger near the base 6 of the nose 4 than at the free end 7 of this latter.

Experience has shown that the best conditions were achieved when the angle (a) is within the range of 45° to a maximum of 90° near the base 6 of the nose 4 and when the angle (b) is within the range of 0° to 15° near the tip 7 of said nose.

Figure 2:
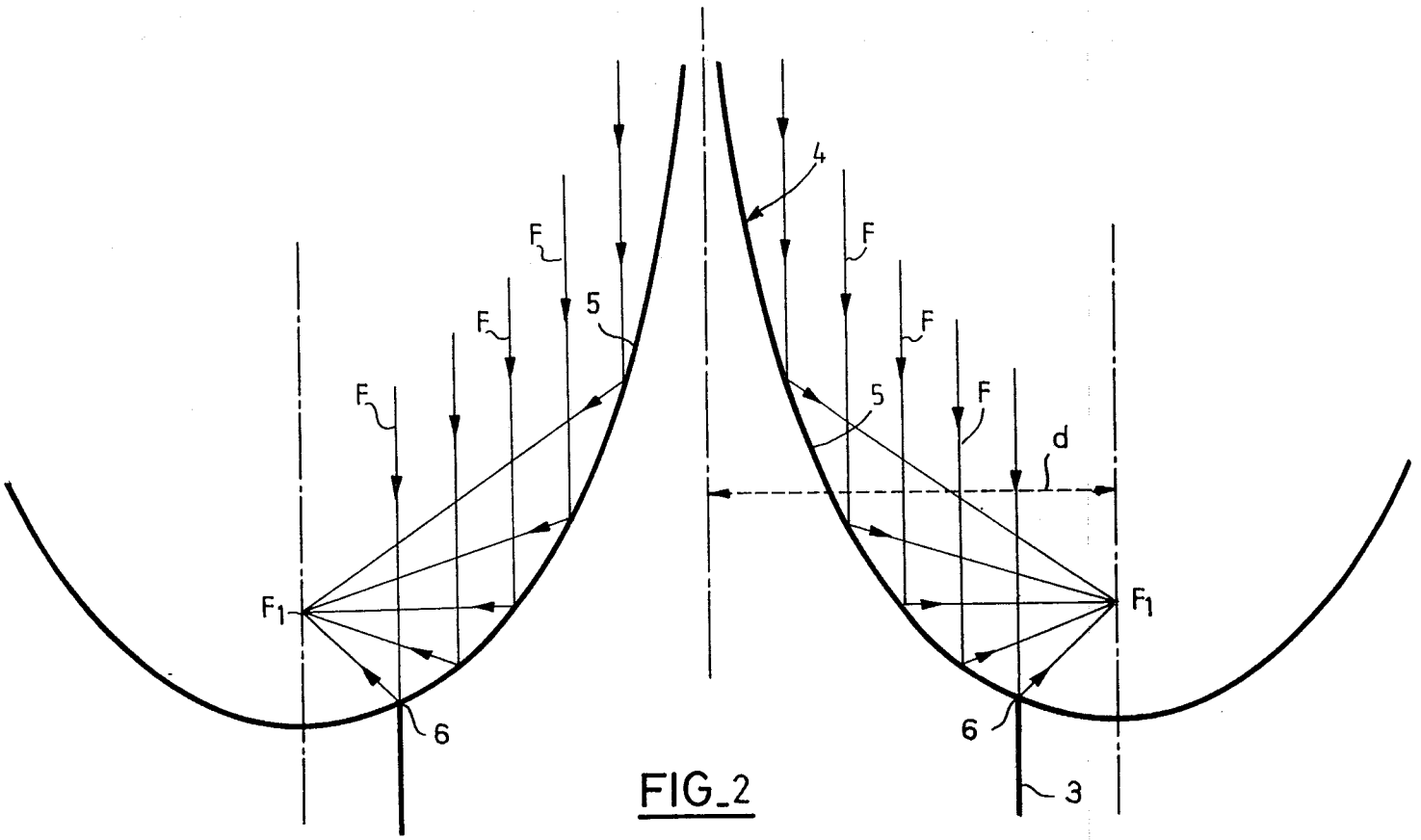
FIG. 2 is a diagram showing the concave lines formed by the nose of the projectile and illustrating the technical effects of this latter.

In the example shown in the drawings, the concave lines 5 are substantially portions of parabola which define a surface having a substantially concave-negative paraboloid shape. The annular focus $F_1$ of said surface is located at a distance d from the axis X—X′ of the projectile, that is, a distance ranging from the radius of the cylindrical body 3 (as shown in FIG. 2) to twice said radius.

The cylindrical body 3 has an internal cavity 8 which is open towards the cartridge case 2 and partly filled with charge powder 9 which is introduced into said cartridge case 2. The cavity 8 consists of a cylindrical volume 8*a* having an extension in the form of a conical head 8*b*.

In the embodiment shown in the figure, the cavity 8 is cylindro-conical and has the maximum volume which is compatible with the mechanical strength of the walls of the projectile 1.

In more precise terms, the thickness of the material within the zones A and B in which the wall of the bullet is subjected to the highest stress at the time of impact must be sufficient to ensure that the nose 4 is practically non-deformable and that the nose 4 is not liable to be thrust back into the cavity 8 under any circumstances, even if the target is a hard body.

The conical shape of the head 8*a* is well-suited to manufacture by machining (turning on a lathe). It would also be possible, however, to contemplate production by diestamping, in which case the profile of the conical head (shown in chain-dotted lines at 8*c*) would advantageously be parallel to the curve 5.

Furthermore, the thickness of the head 8*a* must be such that this portion of the projectile is not liable to flare-out when a shot is fired. The thicknesses can be determined either by calculation or experimentally.

By means of the cavity 8, the mass $M_1$ of the projectile in accordance with the invention can be appreciably reduced with respect to the mass M of a conventional projectile having the same caliber. In practice, advantageous results are obtained if $M_1$ is within the range of M/2.5 and M/5.

As can readily be understood, this weight can be increased to the usual values if so desired by making use of materials which have higher density.

Furthermore, the volume $V_1$ of the cavity 8 can be substantially within the range of 0.5 to twice the total internal volume of the cartridge case 9 prior to fixing of the projectile.

In consequence, even after the projectile 1 has been fixed within the cartridge case 2, the internal volume available for the powder can be very considerably increased, thus making it possible to have a powder charge which is distinctly greater than that employed for conventional ammunition having the same caliber.

By increasing the volume of powder, steps are thus advantageously taken in accordance with the invention to ensure that the initial velocity of the projectile 1 is approximately two to three times higher than that of a conventional projectile of identical caliber. The projectile in accordance with the invention can thus be designated as a very-high-velocity projectile.

Thus a revolver cartridge having, for example, a caliber of 357 magnum as employed by police services and constructed in accordance with the invention has a powder charge increased by nearly 100% and its initial velocity exceeds 1000 m/second.

In practice, the powder charge employed can occupy the entire available volume within the cartridge case 2 and the cavity 8 after the projectile 1 has been fixed within said cartridge case.

If the above-mentioned available volume corresponds to the total internal volume of the cartridge case 2 prior to fixing of the projectile 1 (or is of slightly greater value), a convenient means of filling the cartridge case 2 consists in completely filling said case with powder and in inserting the projectile 1 to the desired depth. The open end of the projectile 1 is provided for this purpose with an annular chamfer 10 which enables the powder to move back into the cavity at the time of engagement of the projectile 1 within the cartridge case 2.

If the internal volume of the cartridge case 2 and of the cavity 8 of the projectile (assumed to be fixed in position) is substantially greater than the total internal volume of the cartridge case 2, the cavity 8 must be at least partly pre-filled with powder before fitting the projectile 1 in the cartridge case 2.

As can readily be understood, a powder filling coefficient which is lower than 1 may be found acceptable, but at the cost of a reduction in initial velocity of the projectile.

A few examples will now be given without any limitation being implied. For a long cartridge case, the volume of the cavity 8 can be one-half the volume of powder (example: caliber 44 Magnum, volume of powder 1.2 $cm^3$, volume of cavity 0.6 $cm^3$). For a short cartridge case, the volume of powder can be double the volume of the cartridge case (example: caliber 38 S 8 W, volume of powder 1.1 $cm^3$, volume of cartridge case 0.5 $cm^3$).

In order to meet the requirements of police forces, the projectile in accordance with the invention is advantageously produced with the calibers 9 mm Parabellum, 38 Special or 357 Magnum, is formed of copper alloy and machined either on an automatic lathe or by die-stamping. Should it be desired to increase the weight of the projectile 1, it is clearly possible to employ metals or alloys which are heavier than copper.

Optimum braking after impact is obtained by virtue of the concave shape of the nose 4 which is preferably constituted by a substantially concave-negative-paraboloid surface as in the case of the embodiment illustrated in the drawings.

It is known that, in the case of a parabolic reflector, the light or heat rays are emitted by the focus in parallel directions. This property has been turned to2 profitable account in the invention by making use of a bullet nose having a substantially concave-negative-paraboloid shape. The adoption of this particular shape will be clearly understood with reference to the diagram shown in FIG. 2.

It is observed in this figure that all the parallel filaments F of matter which impinge upon the half-parabolas 5 constituted by the cross-section of the projectile nose 4 are directed towards the foci $F_1$ of said half-parabolas. The matter thus projected at very high velocity (several Mach) becomes excessively dense, the molecules of matter are "compressed" at the foci $F_1$ of the half-parabolas and the matter is virtually applied against itself. This has the effect of artificially producing an increase of over 100 % in the real caliber of the projectile at the time of slowing-down.

Tests have been performed by firing caliber 357 Magnum projectiles in accordance with the invention into plastiline (plastic material having a consistency which is comparable with that of living tissues). These tests have demonstrated the fact that a projectile in accordance with the invention, when fired at an initial velocity of over 1050 m/second is stopped without fragmentation after penetrating into the above-mentioned material to a depth within the range of 20 to 25 cm. Maximum energy transfer with optimum penetration of the projectile into the target has thus been obtained. In consequence, a wrongdoer hit by a projectile in accordance with the invention is imxediately put out of action or disabled.

The projectile in accordance with the invention is therefore sharply distinguished from projectiles of known types by the effects thus produced.

When it is formed of copper alloy, for example, the projectile in accordance with the invention has excellent perforating power in hard targets such as automobile bodies by virtue of its hardness, its homogeneity and its very high velocity. This perforating power is equal at a minimum to three times the perforating power of fully jacketed conventional projectiles permitted by the provisions of the Hague Convention. However, after having passed through a relatively small thickness of material which simulates living tissues, this projectile is practically no longer dangerous by reason of its substantial losses of velocity and of energy.

Moreover, a further advantageous feature of the projectile in accordance with the invention is the fact that it has a short range and consequently loses its velocity and its energy very rapidly by virtue of the increased aerodynamic braking effect produced by the special concave shape of the projectile nose 4. This feature is highly appreciated by police forces which are required to intervene in operations within built-up areas with high densities of population.

The projectile in accordance with the invention can be employed in conventional cartridges which can be fired in all smooth-bore or rifled firearms. In no instance will it prove necessary to modify or transform the bores of such firearms which will therefore be capable of firing with equal ease both conventional projectiles and the novel projectiles in accordance with the invention. The cartridge cases, primers, percussion caps and powder employed in the construction of these novel cartridges are manufactured in accordance with standard practice. Only the charges and the explosive energies of the powders will be different from conventional cartridges by reason of the lightness of weight of the projectile in accordance with the invention and the considerable increase in the internal charge volume.

A few comparative numerical examples of the projectile in accordance with the invention and of conventional projectiles are given below and clearly show the remarkable properties of the former as well as surprising effects which had not been foreseen by the technical expert:

COMPARATIVE EXAMPLE NO 1

—Caliber 357 Magnum—firing range: 7 meters

1st Shot: 6 commercially available cartridges of the so-called "High-Velocity" type
Armor-piercing bullets: 9.4 g
Mean velocity: 400 m/s at 3 meters
Kinetic energy: 76.6 Kgm
Recoil velocity: 3.9 m/s (Manurhin pistol weighing 0.960 kg)
Linear momentum: 3.76 kg m/s.

2nd Shot: 6 cartridges in accordance with the invention (2.98 g)
Mean velocity: 800 m/s at 3 meters
Kinetic energy: 97.2 Kgm
Recoil velocity: 2.48 m/s (Manurhin pistol weighing 0.960 kg)
Linear momentum: 2.384 kg m/s.

Gain in favor of the invention:
In velocity: 400 m/s, namely an increase of 100%
In energy: 20.6 Kgm, namely 27% extra power
Recoil velocity decreased by 50%.

COMPARATIVE EXAMPLE NO. 2

Measurement of shock effects in plastic material known as Plastiline at 6° C. Same ammunition as above and same firing conditions.

1st Shot: The projectile passed like a sword-blade through a block of Plastiline having a thickness of 60 cm and pierced holes 40 to 45 mm in diameter at the entrance and 20 to 25 mm in diameter at the exit. 2nd Shot: Total stoppage of the projectile after only 13 cm. The entire kinetic energy was thus transferred after a depth of penetration of only 13 cm.

COMPARATIVE EXAMPLE NO. 3

1st Shot: 6 cartridges of the Winchester "Metal-piercing" type (150 grains)
Mean velocity: 286 m/s at 3 meters
Kinetic energy: 40.6 Kgm
Recoil velocity: 3.48 m/s (Colt revolver: 0.800 kg)
2nd Shot: 6 cartridges in accordance with the invention (46 grains)
Mean velocity: 717 m/s at 3 meters
Kinetic energy: 78 Kgm
Recoil velocity: 2.67 m/s (Colt revolver: 0.800 kg)
Gain in favor of the invention:
In velocity: 431 m/s, namely an increase of 150%
In energy: 37.4 Kgm, namely an increase of 92%
Recoil velocity reduced by 24%.

COMPARATIVE EXAMPLE NO. 4

Measurement of perforation capacities in sheet-steel plates having an ultimate yield strength of 65 hectobars/mm $^2$ and plates having an ultimate strength of 110 hectobars/mm $^2$.

1st Shot: 6 Winchester "Metal-piercing" cartridges
Perforation of 65-hectobar steel plate to a depth of 2.5 mm
The plate (3 mm thickness) is not pierced right through.
2nd Shot: 6 cartridges in accordance with the invention (2.98 g)
Perforation to a depth of 4.5 mm in a steel plate having a high ultimate yield strength of 110 hectobars per mm$^2$.

COMPARATIVE EXAMPLE NO. 5

Test involving perforation of bullet-proof waistcoat —Firing range: 7 meters
1 st Shot: 6 cartridges of the Winchester "Metal-piercing" type (150 grains)
The six projectiles were stopped by a bullet-proof waistcoat made up of twenty layers or folds of "Kevlar" and considered as the most effective of all bullet-proof waistcoats since it stops a 44-Magnum bullet fired from an 8-inch barrel as well as 12-caliber boar-hunting bullets.
2nd Shot: 6 cartridges in accordance with the invention (46 grains).
The projectile passed through the bullet-proof waistcoat mentioned above and also through the empty military ammunition box which served as a support for the waistcoat.

These examples clearly demonstrate the surprising properties of ammunition in accordance with the invention as obtained by the combination of means defined in the foregoing.

As will be readily understood, the invention is not limited to the examples hereinabove described and alternative modes of execution may accordinly be contemplated.

From this it follows that the shape of the projectile nose 4 can be constituted by a succession of flat and/or circular surfaces, the essential condition being that the longitudinal cross-section of said nose is defined by two symmetrical concave lines and that said shape produces an optimum slowing-down effect at the time of impact of the nose.

We claim:

1. A cartridge comprising a non-deformable projectile for hand and shoulder weapons having a body and a nose, said nose having a base adjacent to said body and a free end, said body being fitted into a cartridge case filled with charge powder, the longitudinal cross-section of the said nose being defined by two lines which are concave when seen from the exterior and symmetrical with respect to the axis of the projectile, the tangent to each said concave line forming with the axis of the projectile an angle which is larger near the base of the projectile nose than at the free end of said nose, the value of said angle being equal at a maximium to 90° at the base, said body being cylindrical and being provided with an axial cavity, said cavity being open at the end remote from the projectile nose and filled at least to a partial extent with the charge powder in said cartridge case, the volume of said cavity and of said cartridge case and the mass of charge powder contained in said volumes being such that said projectile has an initial velocity which is substantially two to three times higher than that of a conventional projectile having the same caliber and fitted in the same cartridge case.

2. A cartridge according to claim 1, wherein said angle is within the range of 45° to 90 ° near the base of the projectile nose and is within the range of 0° to 15° near the free end of said nose.

3. A cartridge according to claim 1, wherein the surface of the projectile nose has a concave-negative-paraboloid shape.

* * * * *